US006112633A

United States Patent [19]

Trocino

[11] Patent Number: 6,112,633

[45] Date of Patent: Sep. 5, 2000

[54] DISPOSABLE EXPLOSIVE FOAM DISPENSER

[76] Inventor: Joseph Trocino, 15233 Ventura Blvd., Ste. P-8, Sherman Oaks, Calif. 91403

[21] Appl. No.: 09/338,039

[22] Filed: Jun. 22, 1999

Related U.S. Application Data

[60] Provisional application No. 60/090,203, Jun. 22, 1998.

[51] Int. Cl.[7] ..... F42B 33/00; A47C 27/00; A62D 3/00

[52] U.S. Cl. ..... 86/50; 102/293; 102/705; 588/202

[58] Field of Search ..... 102/293, 705, 102/588, 50, 363, 364, 365, 367, 477, 302, 303, 333, 312, 313; 588/202, 203; 86/20.15, 49, 50

[56] References Cited

U.S. PATENT DOCUMENTS 4,008,108 2/1977 Chrisp ..... 149/2

4,614,146 9/1986 Ross et al. ..... 86/20

5,874,688 2/1999 Lubbe et al. ..... 86/20.15

*Primary Examiner*—Charles T. Jordan

*Assistant Examiner*—Aileen J. Baker

*Attorney, Agent, or Firm*—Roger A. Marrs

[57] ABSTRACT

A lightweight aerosol dispenser enclosing a first component of an explosive nature is filled at a factory. A second component is supplied in a smaller container, separate from the dispenser, containing a predetermined amount of propellant. By providing separate containers for each of the explosive and propellant components, both components retain their classification as a flammable substance for transportation and storage purposes. However, in the field, the propellant is injected into the solution container immediately before use. Only after the two substance components have been mixed can an explosive composition be produced. If, for any reason, the explosive composition comprising a foam is not used, it can be washed away with water or will dissipate itself within a few hours.

9 Claims, 1 Drawing Sheet

FIG. 1
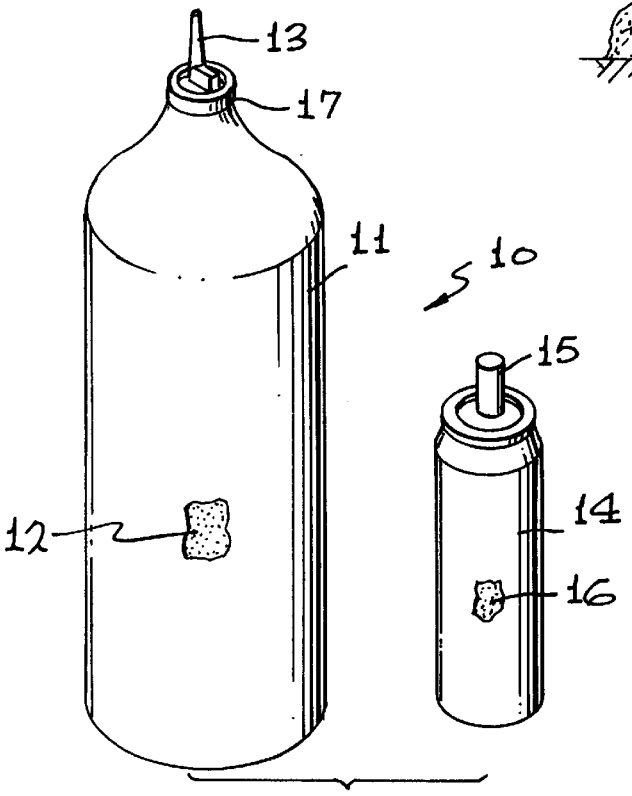
FIG. 4
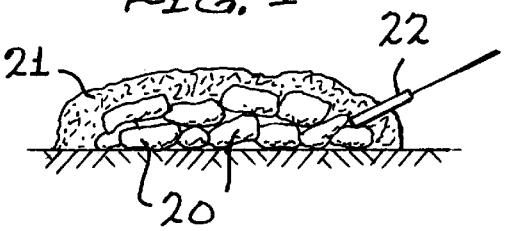
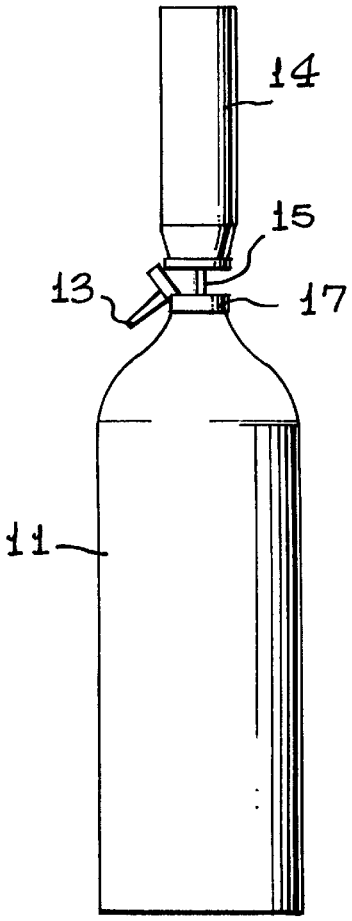
FIG. 2
FIG. 3
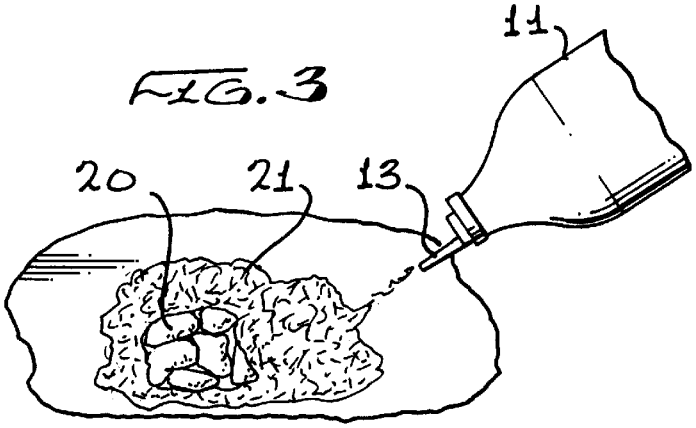

DISPOSABLE EXPLOSIVE FOAM DISPENSER

Priority claimed based on Ser. No. 60-090,203 filed Jun. 22, 1998.

BACKGROUND OF THE INVENTION

1. Field of the Invention

This invention relates to the field of explosive foams, and more particularly to a novel low-cost two-component hand-held delivery system for an explosive foam.

2. Brief Description of the Prior Art

Explosive foam is currently being dispensed by backpack and palletized delivery systems. These units are basically large versions of an aerosol can, where explosive foam solution is the concentrate, and liquid propane is used as the propellant and over-pressured by nitrogen. While these large dispensing systems are ideal for centralized demolition and the attack of multiple targets, feedback from mine action centers has identified a strong requirement for a disposable hand-held dispenser. The aim of a hand-held system is to complement the existing dispensers by offering the proven efficiency and versatility of explosive foam in a simple, low-cost and highly portable unit.

SUMMARY OF THE INVENTION

Accordingly, the above problems and difficulties are avoided by the present invention which provides a light-weight aerosol dispenser for enclosing a first component of an explosive nature (stook solution) which is filled at the factory. The second component is supplied in a smaller capsule, separate from the dispenser, containing a predetermined amount of hydrocarbon propellant, for example liquid propane. By providing separate containers for each of the explosive (stock solution) and propellant components, both components retain their classification as a flammable substance for transportation and storage purposes. However, in the field, the propellant is injected into the stock solution container immediately before use without the need of nitrogen gas over-pressure. Only after the two substance components have been mixed can a resultant explosive foam be produced ready for detonation. If, for any reason, the explosive foam is not used or detonated, it can be washed away with water or will dissipate itself within a few hours.

Therefore, it is among the primary objects of the present invention to provide a safe delivery system wherein the explosive stock solution and the propellant containers would be transported separately and stored separately as a flammable material until the moment the components are combined. Thereby, the two component system poses little danger of misuse by hostile forces and a significant consideration in areas of conflict.

Another object of the present invention is to provide a hand-held dispenser for an explosive foam which is specifically developed to meet the user's need for a highly effective, yet user-friendly demolition system. The unit combines the versatility of a foam with simplicity and sound ergonomic design. The size of the can or dispenser is optimized for safety and handling and yet has sufficient capacity for handling several targets.

A further object of the present invention relates to a hand-held explosive dispensing means which will readily adapt to a variety of discharge nozzles that allow even more latitude in the configuration of the charge and the way in which it is applied.

Still a further object of the novel low-cost hand-held explosive dispenser relates to the handling and mixing of chemical substances with particular respect for the process of insuring correct proportions of components being mixed. The propellant is added to an explosive stock solution in a simple, minimum handling procedure.

Yet another object of the invention resides in providing a two-component hand-held delivery system for an explosive foam which has ease of transport and may be transported as a flammable material rather than as an explosive device. Where one component in a first container is the foam stock solution and the other component in a second container holds a propellant, both are considered a flammable product and can be shipped as such.

Yet a further object of the invention resides in providing an explosive foam for the destruction of unexploded landmines, munitions or ordnance of any nature.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a perspective view of the two-component hand-held delivery system for an explosive substance in accordance with the present invention;

FIG. 2 is a side-elevational view of the two component containers arranged to mix the propellant and foam stock solution together at the moment of use;

FIG. 3 is a diagrammatic view showing application of the foam to destroy unused ordnance; and FIG. 4 is a diagrammatic view illustrating detonation of the explosive foam component.

DESCRIPTION OF THE PREFERRED EMBODIMENT

Referring to FIG. 1, the two-component hand-held delivery system of the present invention is illustrated in the general direction of arrow 10 which includes a first container 11 which holds a foam stock solution substance having approximately a 500-gram aerosol can filled at the factory with the stock solution, indicated by numeral 12. The container 11 is intended to hold a first component consisting of a pressurized potentially explosive foam stock solution such as nitromethane for example. One end of the container includes a dispensing nozzle 13 from which the foam may be dispensed or applied to an unexploded ordnance which is intended to be destroyed. However, it is to be understood that the substance 12 prior to mixing does not include a second component such as a propellant and, therefore, the substance is classified as a flammable substance and may be transported as such.

The second component includes a container 14 having a dispensing nozzle 15 for discharging its contents which take the form of a predetermined amount of hydrocarbon propellant, such as liquid propane for example, and is indicated by numeral 16.

The containers 11 and 14 are of a size, configuration and include pressure limitations such that the containers may be hand-held and are under an approximate weight of one pound. A variety of disposable containers and nozzles are envisioned and are specifically designed for special application. Both the potentially explosive stock solution 12 and the propellant formulations 16 are optimized for foam density and dispersion or discharge.

Referring now in detail to FIG. 2, the propellant 16 is added to with the foam stock solution 12 by placing the nozzle 15 into a receptacle in a cap 17 carried on container 11 after the nozzle 13 has been temporarily repositioned out of the way. The nozzle 15 is of a design which permits discharge of the contents or substance propellant 16 upon flexing or moving of the nozzle with respect to its connection with the cap 17. Such a nozzle is conventional and may be selected from a variety of available nozzles. The correct metering of the propellant 16 is of optimum value to optimize foam density and dispersion. The correct metering of the propellant into the container 11 insures consistent quality production of the explosive foam 12 when being used in the field. The correct packaging for shipment, both domestically and internationally is compatible with the two-component system and includes the type of package, labels required, and the regulations governing the transportation and storage of small containers of flammable material.

After the propellant 16 has been added to the stock solution foam 12 within the container or cannister 11, the container 14 is removed and the nozzle 13 is placed back over the cap 17 so that the combined or mixed propellant and stock solution can be discharged as foam from the nozzle 13.

The application and placement of the two-component mixture 12, 16 from container or cannister 11 is applied to unexploded ordnance, indicated in general by numeral 20. The two-component foamed mixture is indicated by numeral 21 and can be seen as surrounding the unexploded ordnance 20.

Referring now in detail to FIG. 4, the two-component foam 21 may be detonated by insertion of a conventional detonator 22 into the foam and electrically ignited to cause an explosion insitu. The potentially explosive foam offers a highly efficient and versatile alternative to contentional high explosive blocks of solid composition for the demolition of land mines and unexploded ordnance. Such blocks cannot conform to the shape or size of the unexploded ordnance. The inventive low-cost hand-held dispenser 11 comprises a one-pound disposable aerosol container containing the stock explosive solution 12 while a second, smaller container 14 holds the pressurized propellant gas 16. Both containers may be shipped separately and stored as a flammable substance rather than as an explosive substance. The hand-held dispenser provides considerable savings in both cost and logistics. Only after charging the container 11 with the propellant immediately prior to use does an explosive foam come into being. Altogether, this two-component hand-held system offers substantial cost, safety and logistical advantages over existing demolition methods.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A two-component hand-held delivery system for an explosive foam comprising:

a first container holding a quantity of an explosive stock solution;

a second container holding a pressurized propellant;

means carried on each of said first and said second containers for selectively combining said propellant with said explosive stock solution; and said combining means includes a nozzle means mounted on said first container for dispensing said combined propellant and explosive foam at the time of use onto unexploded ordnance.

2. The delivery system defined in claim 1 wherein:

said combining means further includes a discharge nozzle on said second container insertably receivable into said nozzle means on said first container for dispensing said propellant into said first container so as to combine with said explosive stock solution.

3. The delivery system defined in claim 2 including:

detonating means separate from said first and said second container engageable with said combined propellant and explosive foam external of said containers.

4. The delivery system defined in claim 3 wherein:

said combining nozzle means further includes a closable receptacle for insertably receiving said discharge nozzle from said second container to transfer said propellant into said first container for combining with said explosive stock solution.

5. The delivery system defined in claim 4 wherein:

said first container and said second container are hand-held containers and said containers are adapted to contain pressurized contents.

6. The delivery system defined in claim 5 wherein:

said hydrocarbon propellant is liquid propane;

said explosive stock solution is nitromethane-based.

7. A hand-held delivery system for an explosive foam composition comprising the steps of:

placing an explosive stock solution in a first container;

placing a propellant in a second container;

combining the propellant in the second container with the explosive stock solution in the first container at the site of ordnance;

discharging the combined propellant and explosive stock solution from the first container as a foam directly onto the unexploded ordnance; and detonating the discharged resultant explosive foam to destroy the unexploded ordnance.

8. The steps defined in claim 7 wherein said combining step includes:

holding both first and second containers in the hands of the user.

9. The step defined in claim 8 including:

inserting a nozzle of the second container into a nozzle of the first container for transferring the propellant into the explosive stock solution in the first container.

* * * * *